United States Patent [19]

Tsunekawa et al.

[11] Patent Number: 4,740,395

[45] Date of Patent: Apr. 26, 1988

[54] METHOD OF MANUFACTURING COMPOSITE MATERIAL BY COMBINED MELT-SPRAYING

[75] Inventors: Yoshiki Tsunekawa, No. 12, Togogairi, Myodaiji-cho, Okazaki-shi, Aichi; Masahiro Okumiya, No. 360, Takama-cho, Meito-ku, Nagoya-shi, Aichi; Naotake Mohri, No. 3837-3, Shimada Kuroishi, Tenpaku-cho, Tenpaku-ku, Nagoya-shi, Aichi, all of Japan

[73] Assignees: Yoshiki Tsunekawa; Masahiro Okumiya; Naotake Mohri; Mitsubishi Denki Kabushiki Kaisha, all of Japan

[21] Appl. No.: 14,414

[22] Filed: Feb. 13, 1987

[30] Foreign Application Priority Data

Feb. 13, 1986 [JP] Japan ..... 61-29720

[51] Int. Cl.[4] ..... B05B 7/20

[52] U.S. Cl. ..... 427/422; 427/196; 427/423; 427/426; 427/427

[58] Field of Search ..... 427/196, 426, 427, 422, 427/423; 118/315

[56] References Cited

U.S. PATENT DOCUMENTS

| | | | |
|---|---|---|---|
| 1,654,509 | 12/1927 | Claus | 427/423 X |
| 2,199,087 | 4/1940 | Drill et al. | 427/422 X |
| 2,976,166 | 3/1961 | White et al. | 427/423 X |
| 4,075,364 | 2/1978 | Panzera | 427/423 X |
| 4,317,851 | 3/1982 | Neser | 427/426 |
| 4,391,860 | 7/1983 | Rotolico et al. | 427/423 |
| 4,588,021 | 5/1986 | Bergeron et al. | 427/422 X |

*Primary Examiner*—Shrive P. Beck

*Attorney, Agent, or Firm*—Sughrue, Mion, Zinn, Macpeak, and Seas

[57] ABSTRACT

A method of manufacturing a composite material by melt-spraying, comprising the steps of melt-spraying a metal as the main constituent of the composite material onto a base plate and injecting a reinforcing substance comprising discontinuous fibers into the metal melt spray stream upstream of the base plate to effect mixing of the reinforcing substance in the melt-sprayed stream of metal within a temperature range without producing a resultant reaction layer between said metal and said reinforcing substance.

8 Claims, 2 Drawing Sheets

METHOD OF MANUFACTURING COMPOSITE MATERIAL BY COMBINED MELT-SPRAYING

BACKGROUND OF THE INVENTION

1. Field of the Invention

The present invention relates to a method of manufacturing a composite material by melt-spraying to manufacture the composite material wherein either discontinuous fibers or both discontinuous fibers and grains form reinforcing constituents.

2. Background of the Invention

In a conventional method of manufacturing a composite material of such type, a preformed type is made by coating arranged continuous fibers with a melt-sprayed metal as the main constituent of the composite material and then forming the tape by hot pressing. In another conventional method of manufacturing a composite material of such type, a liner material is melt sprayed whose central portion consists of a reinforcing substance and whose peripheral portion is made of a metal as the main constituent of the composite material. In still another conventional method of manufacturing such a composite material, a preformed wire containing discontinuous fibers is melt-sprayed.

In the first mentioned conventional method above, the arranged continuous fiber are positioned in front of a melt sprayer including a melt-spray gun, and either the gun or continuous fibers are moved relative to the other to coat the fibers with the metal to create the preformed tape. A prescribed number of such preformed tapes are then piled together and hot pressed to increase their density or increase the tightness of the tapes at their boundary.

In the conventional method wherein a wire containing the discontinuous fibers is used, the wire is a preformed wire previously made as a composite substance or is a two-layer wire whose central portion includes the discontinuous fibers and whose peripheral portion is a metal forming the main constituent of the composite material. The wire is directly made as a composite material reinforced by the discontinuous fibers. Secondary processing such as high-temperature extrusion is performed in order not only to increase the density of the composite material and its tightness at the boundary between the metal and the discontinuous fibers but also to enhance the reliability of the material.

In the first mentioned conventional method above, the continuous fibers need to be arranged to an appropriate thickness and width so that a uniform metal coating layer can be formed around the fibers. For that reason, the speed of manufacture is very slow. Further, this method cannot be applied to discontinuous fibers because it is impossible to prevent the fibers from scattering.

In the other conventional method wherein discontinuous fibers are used, the fibers are subject to high temperature simultaneously with the melting of the metal because the reinforcing discontinuous fibers are passed through the melt-spray gun. For this reason, the fibers are damaged or molten and gather so that the effectiveness of reinforcement by the fibers is greatly reduced.

SUMMARY OF THE INVENTION

It is an object of the present invention to provide a method of manufacturing a composite material employing discontinuous fibers as a reinforcing constituent, in which the efficiency of the manufacturing is high, in which the fibers are preheated and wherein the temperature of preheating is controlled in order to ensure that the fibers contained in the composite material are neither deteriorated nor gathered. In this invention, the volume ratio of the reinforcing fibers can be altered with the lapse of time or the content of a metal as the main constituent of the composite material can be altered with the lapse of time by using a plurality of melt-spraying lines, in order to effectively strengthen a desired portion of the composite material.

In the composite material manufacturing method of the present invention, the metal and the discontinuous fibers are sprayed from different lines so that the volume ratio of the fibers can be altered in the direction of piling of the metal and the fibers and the composition of an alloy of such metals can be altered in the direction of piling. The efficiency of the reinforcement by the fibers and the efficiency of the manufacturing of the composite material can be made high without deteriorating or gathering the reinforcing discontinuous fibers.

BRIEF DESCRIPTION OF THE DRAWINGS

In the various figures, like elements are provided with like numerical designations.

DETAILED DESCRIPTION OF THE PREFERRED EMBODIMENTS

Figure 1:
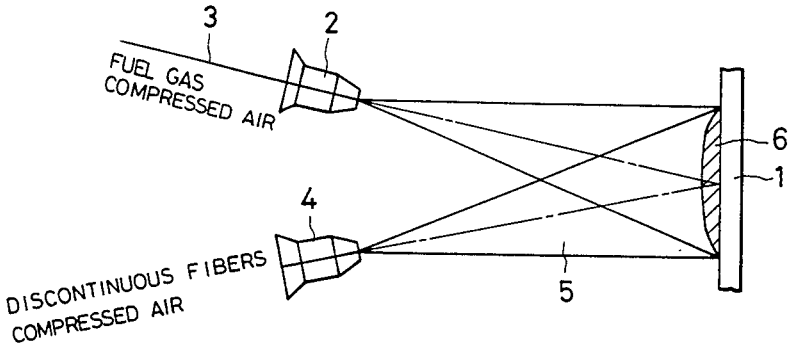
FIG. 1 is a schematic view of a melt-spray system forming a first embodiment of the present invention.

An embodiment of the present invention is now described with reference to FIG. 1 which shows a base plate 1, a melt spraying means or melt-spray gun 2 for melt-spraying a wire 3 as a main-constituent metal onto the base plate 1 by fuel gas or compressed air. An ejection means 4 ejects discontinuous fibers as a reinforcing substance together with comprssed air into the melt-sprayed metal flow wherein the discontinuous fibers are mixed into the melt-sprayed wire 3. A composite material 6 is thus formed on the base plate 1. The wire 3 to be melt-sprayed may be made of an aluminum alloy containing 6% of silicon. Acetylene as fuel and oxygen may be used. The fed quantity of all the gas including the compressed air feeding the discontinuous fibers is about 900 liters/min. Silicon carbide whiskers of 1 micrometer or less in diameter and 30 micrometers in average fiber length are fed as the discontinuous fibers from a hopper (not shown) by using compressed air as a carrier gas. The ejection means 4 may compose a powder gas melt-spray gun to eject the discontinuous fibers by compressed air at about 850 liters/min. to inject them into the flow stream 5 of the melt-sprayed metal. The composite material 6 wherein the discontinuous fibers as a reinforcing substance are dispersed in the metal as the main constituent of the composite material piles on the base plate 1 is located in front of the melt-spraying means 2 and the ejection means 4. The rate of the piling is about 30 mm/min. If the distance between the base plate 1 and the means 2 and 4 is 250 mm. The volume ratio of the fibers piled together with the metal on the base plate 1 is nearly constant, whether the fibers are placed in the peripheral portion or central portion of the composite material 6 and whether the fibers are fed into metal flow stream 5 at the initial stage or final stage of the piling.

The piled composite material 6 is removed from the base plate 1 and then shaped to an arbitrary form. The composite material 6 can be extruded at a high temperature of 550° C. to provide the reinforcing fibers with an orientation to enhance the efficiency of the reinforcement of the composite material 6 simultaneously with the shaping of the material.

In this embodiment, the reinforcing discontinuous fibers are not molten and gathered, so that each of the fibers does not lose its original form. When the fibers come into contact with the metal, the temperature of the fibers is not raised high enough to deteriorate the fibers. The period of time during which the fibers are at a relatively high temperature is short. As a result, the strength of the reinforcing fibers is not reduced and a brittle resultant reaction layer is not produced between the metal and each of the fibers. In that respect, the method provided according to the present invention differs from a composite material manufacturing method in which fibers are dipped in molten metal. Since the composite material 6 is reinforced by the discontinuous fibers, the secondary processing property of the material 6 is excellent. For example, the fibers can be oriented in an axial direction simultaneously with such formation of the composite material 6 as a high-temperature extrusion. Furthermore, the efficiency of manufacturing of the composite material 6 is high.

Figure 2:
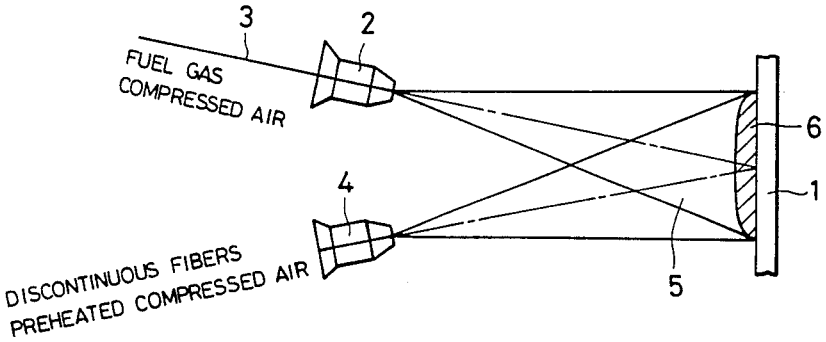
FIG. 2 is a schematic view of a melt-spray system forming a second embodiment of the present invention.

FIG. 2 shows another embodiment of the present invention. The same numerals in FIG. 2 as those used in FIG. 2 denote the same element or equivalent elements, and a detailed description of this embodiment is omitted. The compressed air for carrying the discontinuous fibers is not preheated in the embodiment shown in FIG. 1, while such compressed air is preheated in the embodiment FIG. 2, to enhance the tightness or bond between the metal and each of discontinuous fibers in the embodiment shown in FIG. 2. If the temperature of the fibers and that of the fiber ejection gas are low at the time of the contact of the metal and the fibers in the melt-sprayed flow 5 of the metal, especially when the metal has a high thermal conductivity and a high melting point, some measures need to be taken to enhance the tightness between the metal and the fiber. For example, when pure aluminum and potassium titanate fiber of 1 micrometer or less in diameter and 30 micrometers in average fiber length are used as the metal and discontinuous fibers, respectively, the method of the embodiment shown in FIG. 2 is effective to enhance the tightness of the bond between the fibers and the metal. The method is also effective in enchancing the tightness when a nickel alloy and silicon carbide whiskers are used as the metal and the discontinuous fibers respectively.

Figure 3:
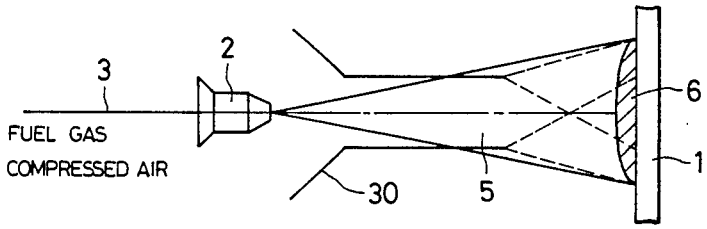
FIG. 3 is a schematic view of a melt-spray system using multiple fiber ejecting ports forming a third embodiment of the present invention.
Figure 4:
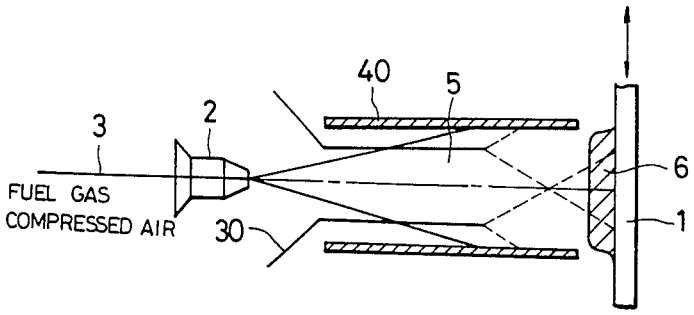
FIG. 4 is a schematic view of a melt-spray system using multiple fiber ejecting ports and a guide cylinder forming a fourth embodiment of the present invention.

FIGS. 3 and 4 show still other embodiments of the present invention. In these drawings, an introducing port 30 effects introducing discontinuous fibers via a carrier gas into metal melt stream 5. Further a tubular guide cylinder 40 improve the yield of the discontinuous fiber. The embodiments shown in FIGS. 3 and 4 are simple methods in which a wire gas melt-spray gun 2 is used only for ejecting a metal, and nitrogen gas or compressed air is used to inject the reinforcing discontinuous fibers into metal stream 5. In each of the embodiments shown in FIGS. 3 and 4, four introducing ports 30 are provided and the flow rate of the carrier gas is about 50 liters/min. The introducing ports 30 are placed in the melt-sprayed flow steam 5 of the metal so as to more uniformly disperse the fibers. The positions of the ports 30 are determined depending on the speed of ejection of the fiber or the flow rate of the carrier gas. If the fibers are ejected into the melt-sprayed flow 5 from outside the flow, the yield of the fibers contained in a composite material made of the metal and the fibers is greatly reduced.

In the embodiment shown in FIG. 4, a guide cylinder 40 is used in order to preheat the carrier gas for introducing the fibers into the melt-sprayed flow 5 and improve the yield of the metal and the fibers. The base plate 1 is moved vertically or moved in the X and Y directions to effect piled composite material over a large area, which material is subjected to secondary processing such as rolling.

Figure 5:
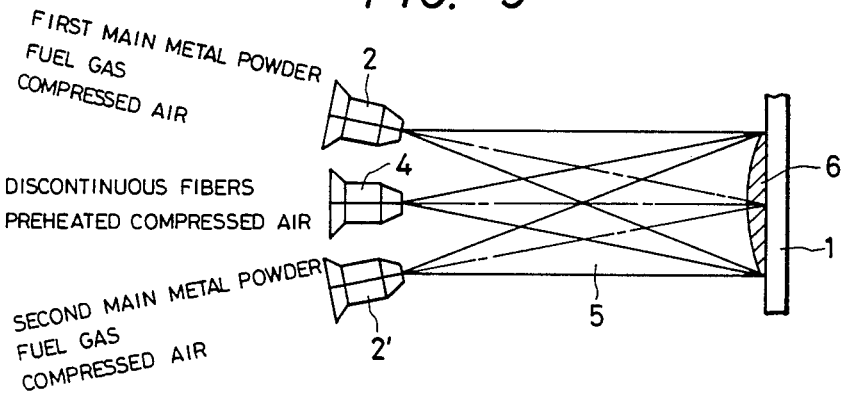
FIG. 5 is a schematic view of melt-spray system using plural metals spray guns forming another embodiment of the present invention.
Figure 6:
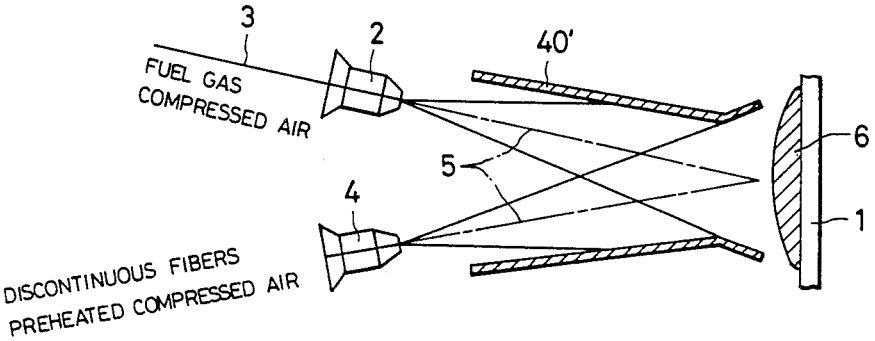
FIG. 6 is a schematic view of a melt-spray system using separate spray guns for the metal spray and the discontinuous fibers and a conveying/awaying guide tube forming yet another embodiment of the present invention.

FIGS. 5 and 6 show still other embodiments of the present invention.

In the embodiment shown in FIG. 5, a powdered mixture comprising 6% of silicon and the rest of aluminum and another powdered mixture comprising 2% of copper, 0.7% of magnesium and the rest of aluminum constitute a first and a second metals, and two powder gas melt-spray guns 2 and 2' are used for melts spraying the respective metals. A powder gas melt-spray gun 4 ejects reinforcing fibers while preheating the fibers and air. Therefore, three melt-spray guns are used in all. The quantity of the first metal is increased at the initial and final stages of the manufacturing of a composite material, while the quantity of the second metal is gradually increased in the middle stage of the manufacturing. The manufactured composite material is forged at a high temperature of 550° C. The top and bottom layer of the composite material so formed during spray pile up is made of a metal of high resistance to wear, while the middle layer of the material is made of a metal which ages at room temperature and has a high strength. In this embodiment, the volume ratio of the reinforcing fibers is not altered. However, the volume ratio can be altered if desired. Reinforcing fibers, reinforcing grains and a metal can also be ejected respectively from three melt-spraying lines to manufacture a composite material reinforced by both the fibers and the grains.

In the embodiment shown in FIG. 6, two melt-spray guns 2 and 4 are used, and a bent conveying/diverging guide 40 is provided in order to enhance the yield of reinforcing fibers. Besides melt-spraying shown in FIG. 6, arc melt-sraying or plasma melt-spraying can be performed to supply a metal as the main constituent of the composite material. When plasma melt-spraying, a ceramic can be substituted instead of the metal to manufacture a fiber-reinforced ceramic.

According to the present invention, the discontinuous fibers are not passed through the very high temperature portion of melt-spraying system. A separate means is used to introduce the fibers, or a melt-spraying means is used for preheating the fibers and the gas or a melt-spraying means basically imports only kinetic energy to the fibers in order not only to eject the fibers but also to melt-spray the metal. As a result, a composite material is created in which the reinforcing descontinuous fibers are not deteriorated or gathered. The volume ratio of the fibers can be altered during piling up of the fibers and the metal. A plurality of melt-spraying means can be used so that the composition of an alloy of melt-sprayed metals can be altered during direction piling up the metal and discontinuous fibers.

According to the present invention, reinforcing fibers are ejected from a line different from that for a metal, so that the mixing of the metal and the fibers is completed in a short time and a brittle resultant reaction layer is prevented from being produced. The mixing of the fiber will the metal melt is performed at such a temperature that the reinforcing fibers are not deteriorated or rendered molten and gathered in the melt-sprayed flow stream of the metal. A composite material is thus easily manufactured from the metal and the reinforcing fibers. A metal alloy can be formed and the volume ratio of reinforcing fibers to metal and the composition of the metal alloy can be altered during piling up of the metal and the fibers. Further the composite material can be secondarily processed after spray deposition.

What is claimed is:

1. A method of manufacturing a composite material by melt-spraying, comprising the steps of:

melt-spraying a metal as the main constituent of said composite material in a metal melt spray stream onto a base plate, and injecting a reinforcing substance comprising elongate discontinuous fibers into the metal melt spray stream up stream of said base plate to effect mixing of said reinforcing substance in the melt-spray stream of metal within a temperature range without producing a resultant reaction layer between said metal and said reinforcing substance.

2. The method as claimed in claim 1, wherein said discontinuous fibers and said metal are ejected from separate spray guns onto said base plate.

3. The method as claimed in claim 1, wherein the discontinuous fibers are injected by said injecting step into the metal flow steam by pre-heated compressed air, thereby enhancing the bond between the metal and the discontinuous fibers.

4. The method of claim 1, wherein the discontinuous fibers are injected in the injecting step into the metal flow stream by a carrier gas through at least one introducing port placed in the melt-sprayed metal flow stream.

5. The method of claim 4, wherein a tubular guide surrounds the flow stream to thereby prevent loss of injected discontinuous fiber after injection from the flow stream prior to fiber impingement on the base plate and to preheat the carrier gas.

6. The method of claim 4, wherein in said injecting step the discontinuous fibers are injected into the melt-sprayed metal flow stream by four introducing ports.

7. The method of claim 1, wherein in said melt-spraying step different metals are separately ejected from respective melt-spray guns onto said base plate and the rate of melt-spraying from said guns is varied during build up of the composite material on the base plate to vary the composition of the metal alloy produced thereby.

8. The method of claim 7, further comprising the step of varying the rate of said injecting of the discontinuous fibers into the flow steam of metal deposited in said base plate during build up to vary the reinforcing of one or more layer of melt-sprayed composite material during build up thereof.

* * * * *